United States Patent [19]

Unetich et al.

[11] 4,267,487

[45] May 12, 1981

[54] REGULATED FILAMENT SUPPLY FOR HIGH-POWER TUBES

[75] Inventors: Robert M. Unetich, Pittsburgh; William Shibler, Bethel Park, both of Pa.

[73] Assignee: RCA Corporation, New York, N.Y.

[21] Appl. No.: 136,697

[22] Filed: Apr. 2, 1980

[51] Int. Cl.[3] ..... G05F 1/64

[52] U.S. Cl. ..... 315/107; 315/141; 315/307; 328/270

[58] Field of Search ..... 315/106, 107, 141, 291, 315/307, 311; 328/265, 270; 323/22 T, 66, 89 R

[56] References Cited

U.S. PATENT DOCUMENTS

| | | | |
|---|---|---|---|
| 3,022,458 | 2/1962 | Sola | 315/311 X |
| 3,078,388 | 2/1963 | Hanks et al. | 315/107 |
| 3,517,253 | 6/1970 | Dietz | 315/400 |
| 3,767,960 | 10/1973 | Ahrens | 315/408 |
| 3,895,256 | 7/1975 | Reh et al. | 315/371 |
| 3,914,653 | 10/1975 | Forster et al. | 315/411 X |

*Primary Examiner*—Eugene R. LaRoche
*Attorney, Agent, or Firm*—Eugene M. Whitacre; Paul J. Rasmussen; William H. Meise

[57] ABSTRACT

A high power tube in applications requiring reduced AC hum in the amplified signal, utilizes a direct current heated filament. In order to reduce the incidence of tube failure and maintain a stable mode of operation, the direct current is produced by a regulated source of DC voltage. The regulated source includes a transformer having a primary winding coupled to a source of alternating line voltage and also includes a secondary winding at which a transformed low voltage is generated. A rectifier is coupled to the secondary winding for rectifying the transformed voltage to produce a pulsating direct voltage which is applied to the tube filament by a filter. The primary winding of the transformer is coupled to the AC source by means of a saturable reactor. A control circuit senses the voltage across the filament and controls the reactor in a feedback manner.

7 Claims, 1 Drawing Figure

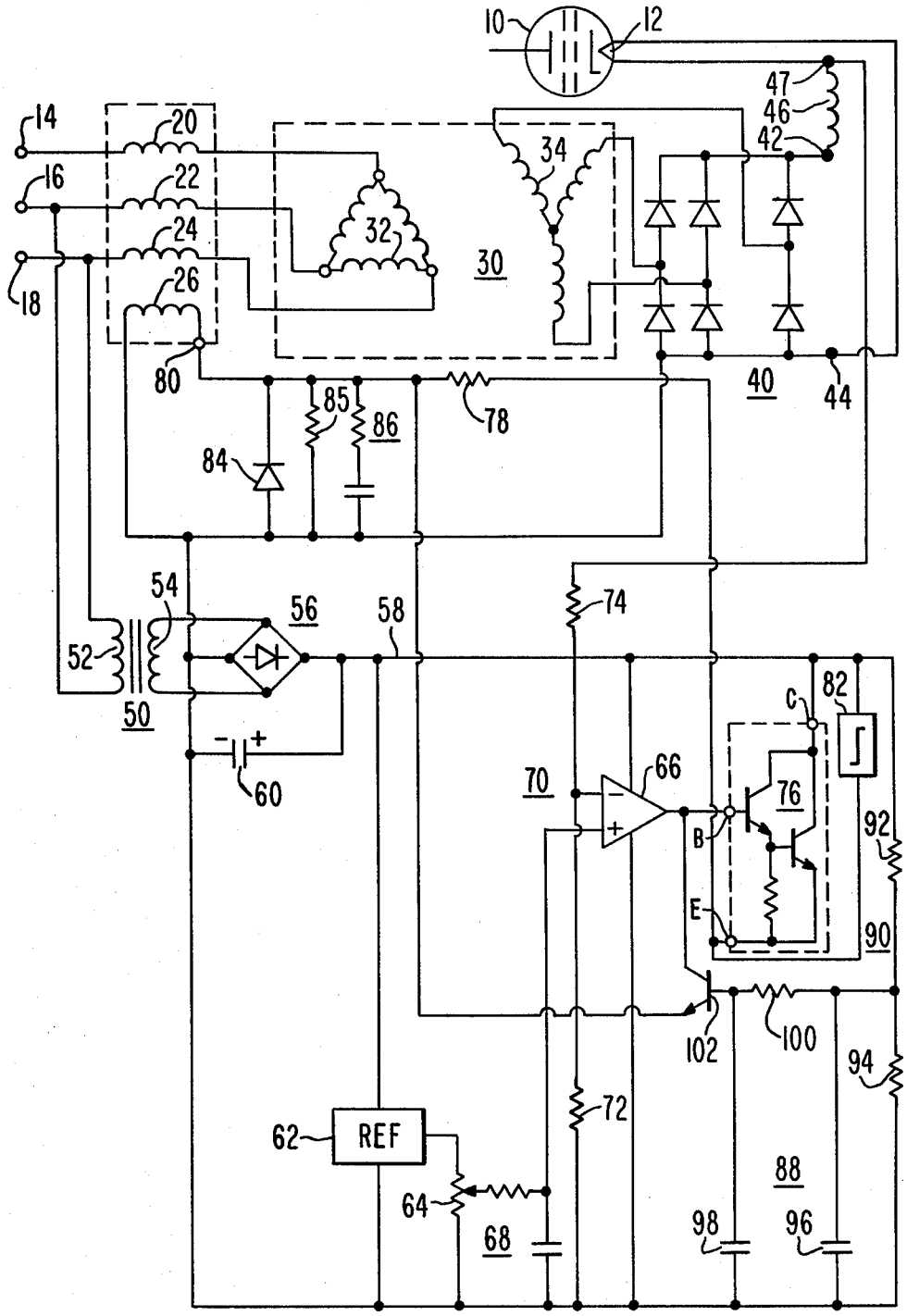
10
12
14
16
18
20
22
24
26
30
32
34
40
42
44
46
47
50
52
54
56
58
60
62
REF
64
66
68
70
72
74
76
78
80
82
84
85
86
88
90
92
94
96
98
100
102
B
C
E

REGULATED FILAMENT SUPPLY FOR HIGH-POWER TUBES

BACKGROUND OF THE INVENTION

This invention relates to regulated power supplies for supplying power at low voltage and high current for the filaments of high-power tubes such as those used in transmitters.

Large power vacuum or electron tubes often have filaments or cathode heaters which are heated by a flow of current in order to allow electrons to be "boiled off" for use by the tube. Power tubes by their very nature often require large quantities of electrons, and consequently large amounts of filament heating power are required. In practice, power tubes are usually operated with relatively high filament current and comparatively low voltage. This type of filament structure (low impedance) is used because, among other reasons, it results in a rugged construction, free from mechanical problems, compared with high-impedance filaments. These considerations lead to a low voltage, high current filament or heater (hereinafter termed filament) supply. The filament is normally sealed into the vacuum tube at the time of manufacture, and failure of the filament requires that the tube be discarded. Where the tubes are very expensive, as in high-power high-frequency television transmitters and the like, it is very desirable to protect the filament insofar as possible from overvoltage conditions which might result in failure. Consequently, it is desirable to regulate the power applied to the filaments.

The filament, however, being essentially a resistive element, has an impedance when cold or at turn-on which is much lower than the operating impedance. Consequently, a regulator for use as a high-power filament supply must also be "short-circuit" proof. Attempts to use semiconductor controlled rectifiers for regulation in a phase-controlled manner have encountered problems, because the turn-on surges resulting from the low impedance of the filament tend to cause failures of the controlled rectifier. A failure of the degraded controlled rectifier in a conductive mode applies uncontrolled full voltage to the filament which may in turn fail. Thus, failure of a controlled rectifier can cause failure of an extremely expensive power tube. Even when the aforementioned turn-on surges do not cause SCR failures, they pose a threat to tube life by subjecting the power tube filament to excessive current and stresses during turn-on. Also, SCR regulators produce AM switching noise. As a result, notwithstanding the advantages of regulating the filament current, the filament supply is often unregulated, in order to avoid difficulties such as those mentioned.

It is desirable in order to provide power to the filament in an efficient manner to use a three-phase power system. Thus, a current television transmitter uses unregulated three-phase AC power driving a transformer which transforms the line voltage to a low voltage. The output of the transformer in turn is coupled to a three-phase rectifier which produces pulsating direct current, which in turn is applied to the filament by a filter choke. Direct current is used on television transmitter filaments to reduce picture aberrations caused by filament supply hum, such as horizontal hum bars, etc. This arrangement is reliable, because it includes only wire, transformer iron and reliable solid-state rectifiers.

One form of regulator which has been used successfully as a filament supply in a television transmitter includes a ferroresonant transformer. The ferrorresonant transformer is operated in saturation during a considerable portion of each operating cycle. The switching of the transformer between saturation states heats the transformer, dissipating large amounts of power over that transformed for use by the filament. Consequently, the ferroresonant transformer arrangement may be less efficient than desired. Additionally, if it is desired to use a three-phase source, the ferroresonant transformer approach becomes impractical. Also, the ferroresonant approach even for single-phase operation requires large chokes and filter capacitors.

It is desirable to have a high-current low-voltage filament power supply regulator which is resistant to short-circuits in the load and has high efficiency and relatively low noise.

SUMMARY OF THE INVENTION

An improved tube arrangement includes a high-power electron tube having a filament. A transformer has a secondary winding and a primary winding which is coupled to a source of AC line voltage for causing a transformed line voltage to appear on the secondary winding. A rectifying arrangement is coupled to the secondary winding for rectifying the transformed line voltage to produce a pulsating direct voltage. A filter is coupled to the filament and to the rectifier for filtering the pulsating direct voltage to produce a filtered direct voltage which is applied to the filament. According to the improvement, the primary winding is coupled to the AC line voltage source by the working or controlled winding of a saturable reactor. The impedance of the saturable reactor is controllable for varying the current supplied to the primary winding. A control circuit is coupled to the saturable reactor and to the filament, the voltage of which is regulated, for controlling the impedance of the controlled winding of the saturable reactor in a feedback manner for regulating the filtered direct voltage applied to the filament.

DESCRIPTION OF THE DRAWING

The sole FIGURE illustrates a tube with a heating filament and a regulated power supply therefor.

DESCRIPTION OF THE INVENTION

In FIG. 1, a tube 10 includes a filament 12 to be heated. At the left of FIG. 1, a three-phase source of alternating current (not shown) is applied to input terminals 14, 16 and 18. Terminals 14, 16 and 18 are each connected to a saturable reactor assembly including saturable reactors 20, 22 and 24. Saturable reactors 20–24 are controlled by individual control windings coupled in series and illustrated together as a control winding 26. The ends of saturable reactors 20, 22 and 24 remote from input terminals 14, 16 and 18, respectively, are coupled to the delta-connected primary windings 32 of a three-phase voltage step-down transformer designated generally as 30. A wye-connected secondary winding 34 of transformer 30 is connected in known manner to a three-phase rectifier designated generally as 40. Rectifier 40 rectifies the transformed low voltage power to produce a pulsating direct voltage across terminals 42 and 44. Terminals 42 and 44 are coupled to filament 12 by means of filter choke 46. Filter choke 46 smooths the pulsating direct voltage waveform to produce a direct voltage across filament 12.

The remainder of the arrangement of FIG. 1 is a feedback control circuit by which control winding 26 is supplied with a control signal for control of the impedance of saturable reactors 20, 22 and 24 for controlling the current flow to primary winding 32 for maintaining the direct voltage across filament 12 at a constant value. Primary winding 52 of a transformer designated generally as 50 is coupled to input terminals 16 and 18 for tapping off a small amount of power for the control circuit. A secondary winding 54 of transformer 50 is coupled to opposite legs of a bridge rectifier designated generally as 56. Another terminal of bridge rectifier 56 is connected to terminal 44. Terminal 44 is hereafter referred to as ground for ease of understanding of the control circuit. The fourth terminal of rectifier 56 is connected to a power bus 58. A filter capacitor 60 is coupled between power bus 58 and ground and an operating voltage for the control circuit appears thereacross.

A reference direct voltage source illustrated as a block 62 is coupled between bus 58 and ground, and produces across potentiometer 64 a direct voltage which may be used as a reference. A high-gain amplifier 66 has its noninverting input connected to the wiper on potentiometer 64. A resistor-capacitor network 68, connected as a low-pass filter, is coupled between the wiper and ground. This network incorporates a time constant such as to cause a gradual, delayed, application of reference voltage to the noninverting input to amplifier 66. The network thus causes a gradual application of filament voltage, at start-up. The network also acts to suppress noise pulses from the reference source. The inverting input of amplifier 66 is coupled to the tap on a voltage divider designated generally as 70 and including resistors 72 and 74 coupled between terminal 47 and ground. Amplifier 66 acts as a comparator for comparing the filtered direct voltage applied to filament 12 with the reference voltage at the wiper of potentiometer 64. The output of amplifier 66 is connected to the effective base B of a Darlington-connected power amplifier 76 equivalent to an NPN transistor. The effective collector C of amplifier 76 is connected to bus 58, and the effective emitter E is coupled by a small-value resistor 78 to a terminal 80 of control winding 26. The other end of control winding 26 is grounded. A varistor 82 is coupled across the effective collector and emitter of amplifier 76.

In operation, a small amount of ripple voltage can be expected to appear across filament 12. This ripple voltage is coupled to the input of amplifier 66 and when compared with the reference voltage causes amplifier 66 to switch and causes the output voltage of amplifier 66 to alternately take on values near ground and near the voltage of supply bus 58. As a consequence, power amplifier 76 will be turned on and off, alternately connecting control winding 26 between supply bus 58 and ground and disconnecting it. The switching of the output voltage of amplifier 66 is pulse-width modulated in response to slight variations in the voltage applied to filament 12 and causes time modulation of the voltage pulses applied to control winding 26.

The switching action described results in a very efficient operation of power amplifier 76, since this amplifier is either in the off (or low) state, between pulses, or switched on in heavy conduction during pulses. Both conditions are conducive to high efficiency operation of amplifier 76, compared with linear regulator amplifiers used in similar applications.

A diode 84 has its anode connected to ground and its cathode connected to terminal 80. This device acts as a power transient suppressor, limiting the voltage at terminal 80 to a maximum value which is safe for power amplifier 76, transistor 102, etc. Resistor 85 is connected across control winding 26. Resistor 85 acts to allow the inductance of control winding 26 to integrate the time-modulated voltage pulses applied to the winding to form a substantially continuous or direct current therethrough for continuous control of the impedance of windings 20, 22 and 24. A resistance-capacitance damping network designated generally as 86 is coupled across winding 26 to suppress noise and to suppress any tendency toward unwanted oscillation of the feedback loop, which is relatively high gain.

During those intervals in which power amplifier 76 is conductive diode 84 is back-biased and current is increasing in control winding 26. However, when amplifier 76 is nonconductive, the voltage across winding 26 decreases to become near the voltage at ground. Any tendency of terminal 80 to become appreciably negative with respect to ground is limited to approximately −0.7 volts (1 diode drop) by forward conduction of diode 84. A protective circuit designated generally as 88 acts to protect amplifier 76 from excessive current requirements such as might occur if control winding 26 were short-circuited. Circuit 88 includes a voltage divider designated generally as 90 and including resistors 92 and 94 coupled between bus 58 and ground. A filter including capacitors 96 and 98 and a resistor 100 provides a reference voltage to the base of an NPN transistor 102. The collector of transistor 102 is connected to the output of amplifier 66 and the emitter is connected to terminal 80. If, for some reason, the output current from amplifier 76 should become excessive, the voltage drop across (low value, typically 0.21 ohms) resistor 78 is greatly increased. The polarity of this (increased) voltage drop is such as to increase the conduction through transistor 102. This increased conduction of transistor 102 diverts the output current from amplifier 66 from the effective (input) base of power amplifier 76. This results in greatly reduced conduction through amplifier 76, thereby affording useful protection of the components comprising amplifier 76. This circuit is similar to other arrangements used for regulator protection, referred to as "current-limiting" or "fold-back" type power supplies.

The main power-handling portion of the described regulator includes transformer and reactor iron, wire and rectifiers 40. Consequently, the arrangement is substantially impervious to the effects of turn-on transients. There are no controlled rectifiers which might fail and thereby destroy the tube. The iron core of the saturable reactor is not switched between saturation states, and therefore dissipates relatively little power.

Other embodiments of the invention will be obvious to those skilled in the art. For example, a single-phase system or a two-phase system may be used. Any known type of feedback control generator can be substituted for the one described. The wye secondary as described is advantageous because it allows fewer secondary turns than a delta for the high-current secondary, but a delta-connected secondary could be used. It is desirable to have at least one delta-connected winding in the transformer to provide a path for the flow of harmonic currents and to minimize waveform distortion, but as is known any combination of delta and wye windings can be used.

What is claimed is:

1. An improved tube arrangement comprising:

a high-power electron tube including a heating filament;

a source of alternating line voltage;

a transformer including a primary winding and a secondary winding;

coupling means coupling said primary winding to said source of alternating line voltage for causing a transformed line voltage to appear at said secondary winding;

rectifying means coupled to said secondary winding for rectifying said transformed line voltage to produce a pulsating direct voltage;

filtration means coupled to said filament and to said rectifying means for filtering said pulsating direct voltage to produce a filtered direct voltage and for applying said filtered direct voltage to said heating filament;

wherein the improvement lies in that:

said coupling means comprises saturable reactor means interposed between said source of alternating line voltage and said primary winding for presenting a controllable impedance to said alternating line voltage source for varying the current supplied to said primary; and wherein the improvement further comprises:

saturable reactor control means coupled to said saturable reactor and to said filtration means for controlling said impedance in a feedback manner for regulating said filtered direct voltage applied to said filament.

2. An arrangement according to claim 1 wherein:

said source of alternating line voltage is a three-phase source;

said primary and secondary windings of said transformer are three-phase windings; and said rectifying means is a three-phase rectifier.

3. An arrangement according to claims 1 or 2 wherein said saturable reactor includes a three-phase controlled winding.

4. An arrangement according to claim 2 wherein said primary winding is delta-connected and said secondary winding is wye-connected.

5. An arrangement according to claim 1 wherein:

said saturable reactor control means comprises a high-gain amplifier including an output and first and second inputs, said first input being coupled to said filtration means for sampling said filter direct voltage and said output being coupled to said saturable reactor in said feedback manner.

6. An arrangement according to claim 5 further comprising:

reference voltage means coupled to said second input of said high-gain amplifier for causing said high-gain amplifier to operate in a switching mode in response to ripple in said filtered direct voltage for producing a pulsatory control signal for control of said saturable reactor in said feedback manner.

7. An arrangement for powering a filament, comprising:

a source of alternating voltage;

a saturable reactor including a control winding and a working winding, said working winding including a first terminal and a second terminal, said first terminal being coupled to said source of alternating voltage;

a transformer including a secondary winding and also including a primary winding coupled to said second terminal of said working winding for producing a transformed voltage at said secondary winding;

rectification means coupled to said secondary winding for rectifying said transformed voltage to produce a pulsating direct voltage having an effective direct magnitude;

coupling means for coupling said rectification means with said filament for causing heating of said filament; and control means coupled to said control winding and responsive to said effective direct magnitude for controlling said saturable reactor in a feedback manner for maintaining said effective direct magnitude at a substantially constant value.

* * * * *